United States Patent [19]

Bianchi et al.

[11] 3,977,583

[45] Aug. 31, 1976

[54] FRONT OPENING HOLSTER

[75] Inventors: John E. Bianchi; Richard D. E. Nichols, both of Fallbrook, Calif.

[73] Assignee: Bianchi Leather Products, Inc., Temecula, Calif.

[22] Filed: July 29, 1974

[21] Appl. No.: 492,757

[52] U.S. Cl. ..... 224/2 B
[51] Int. Cl.[2] ..... F41C 33/02
[58] Field of Search ..... 224/2 B, 2 C

[56] References Cited

UNITED STATES PATENTS

| | | | |
|---|---|---|---|
| 2,001,321 | 5/1935 | Berns | 224/2 B |
| 2,109,232 | 2/1938 | Hoyt | 224/2 B |
| 2,917,213 | 12/1959 | Bucheimer et al. | 224/2 B |
| 3,749,293 | 7/1973 | Bianchi | 224/2 B |

*Primary Examiner*—Robert G. Sheridan
*Attorney, Agent, or Firm*—John E. Wagner

[57] ABSTRACT

An improved front opening holster including depending enclosed spring members extending along the edges of the front opening. The spring members have free ends and are operatively secured together by a retainer in the completed holster but relatively movable during manufacture to facilitate production.

The body includes an elongated stiffening member providing attachment point of a belt loop and defines a cylinder cup shape as well.

The belt loop includes a stiffening member and a distortable spacer and tightening means to expand and contract the spacer to selectively engage or release the belt to afford both free movement and fixed engagement with the wearer's belt.

The hammer of a handgun positioned in the holster is covered by an overlying strap. A thumb strap with a selective direction release fastener engages the overlying strap in a recess between the handgun and the belt loop.

A novel method for producing a spring closed holster, particularly the spring assembly, is disclosed.

12 Claims, 11 Drawing Figures

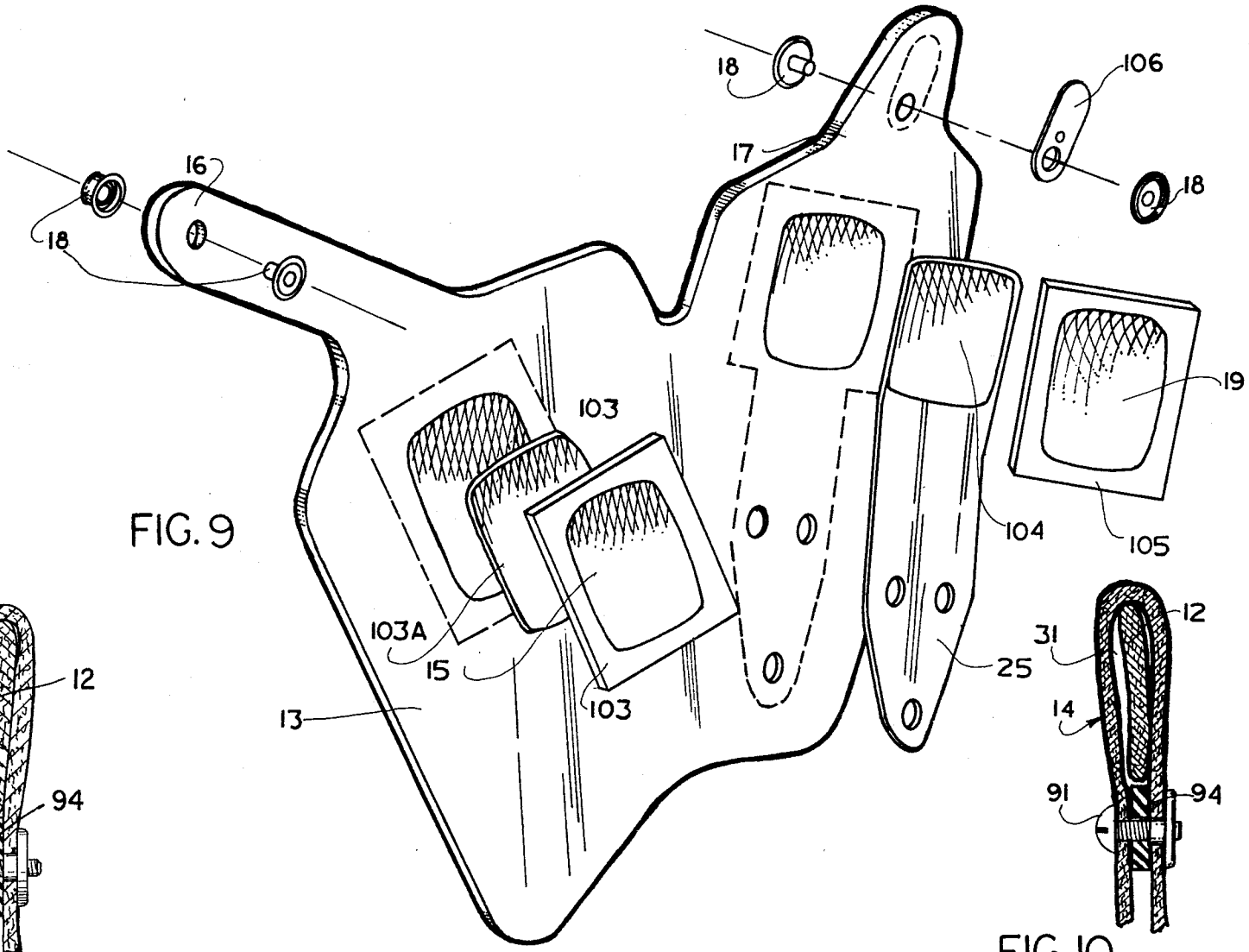
FIG. 9
FIG. 10
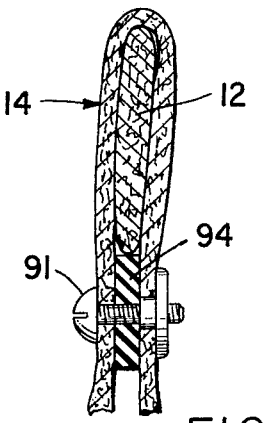
FIG. 11

FRONT OPENING HOLSTER

BACKGROUND OF THE INVENTION

Through the years the need for a truly effective front opening holster, particularly for law enforcement work has been recognized. Early work by J. E. Berns represented in U.S. Pat. No. 2.001,321 combined a leather holster body with an internal spring to mechanically bias the sides of the holster together while allowing front withdrawal of the handgun. The spring embraces the cylinder portion of the gun.

We discovered that the use of a wire spring which extends along the entire edges of the front opening and is formed in a generally vertical U shape provides superior closing of the front opening and more uniform withdrawal pressure requirements on the gun. This arrangement plus cylinder recesses, which prevent upward withdrawal of the gun, are disclosed in U.S. Pat. No. 3,630,420.

An improved low mounting for front opening holsters as well as a modified U spring are disclosed in my patent, U.S. Pat. No. 3,749,293.

Other representative patents disclosing front opening holsters with wire spring closures are:

U.S. Pat. No. 3,642,183 to Boren; and

U.S. Pat. No. 2,109,232 to Hoyt.

Despite the advances made in the past in front opening holsters, a number of minute and hardly perceptible relationships between the holster body, the spring, the closure strap, the gun and the wearer's hand have been unrecognized.

For example, any spring closure holster having the spring located only in the cylinder region, or with the base of the U in the muzzle will exert a non-uniform pressure on the barrel of the gun, causing what is termed "muzzle drag."

A holster which covers the trigger guard also tends to limit the hand engagement of the grip during the early stages of drawing the gun.

A front opening holster with a vertical U shaped spring is necessarily longer than desired to provide room for the U portion of the spring and is closed, producing a pocket which collects debris. The front opening holster with this muzzle drag may cause sliding of the holster on the belt and uncertain drawing of the gun.

Closure straps which may be easily unsnapped by the wearer on drawings, may also become unsnapped inadvertantly or by others, and often metal fasteners contact the gun causing wear or interference with the draw. Closure straps which cover the hammer often interfere with the draw. Rear sights are often either unprotected or, if enclosed, have unwanted contact with the holster. Holsters having low mounting belt loops have often tended to distort and bow outward with use and wearing.

These and other heretofore unrecognized design details have limited the overall utility of holsters in general, and front opening holsters in particular.

A continual problem has been the need for firm spring closing of front opening holsters and, at the same time, one which can practically be assembled with the spring securely sewn within the holster.

BRIEF STATEMENT OF THE INVENTION

Upon discovery and examination of each of the foregoing deficiencies in prior art holsters, we have invented a front opening holster which eliminates all of these deficiencies and incorporates of additional features as well. It comprises a holster body including an outer shell and an inner lining defining a handgun retaining cavity with cylinder cavities and a front opening for removal of the gun. The front opening is mechanically biased together by a pair of inverted U shaped spring members which extend from the closed rear edge of the holster, over the cylinder cavities, if present, and downward to the free end. The spring members are sewn between the shell and liner and are mechanically coupled together at their innermost ends and free at the front opening. So arranged, the entire front opening exhibits a substantially uniform resistance to opening. The free end arrangement allows the bottom of the holster to be open.

The body includes a stiffening member extending nearly the full length and defines one cylinder recess. This member, alone and in cooperation with the U shaped springs, insures shape and stability of the holster.

The closure straps are formed integrally with the body and are positioned to overlie the hammer region of the handgun. The closure straps include recessed directional snaps which allow opening only by forward movement of the wearer's hand.

The holster body includes a portion extending to nearly cover the trigger and trigger guard of the handgun but does not extend to interfere with the third, fourth or fifth finger of the wearer in grasping the grip.

One other feature of this invention is a novel spring assembly for front opening holsters.

BRIEF DESCRIPTION OF THE DRAWINGS

The foregoing features may be more clearly understood from the following detailed description and by reference to the drawing in which:

FIG. 9 is an exploded view of the shell portion of this invention;

FIG. 10 is a vertical sectional view of a belt and belt loop assembly in the unlocked condition; and FIG. 11 is a view similar to FIG. 10 with the belt loop assembly locked.

DETAILED DESCRIPTION OF THE INVENTION

Figure 1:
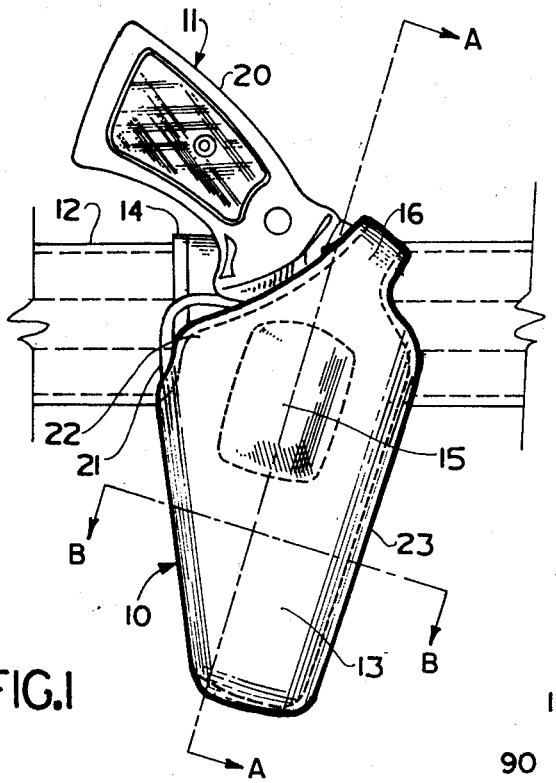
FIG. 1 is a side elevational view of a holster in accordance with this invention.

Now referring to FIG. 1, a typical holster 10 incorporating this invention is shown for holding a handgun 11 and itself supported on a belt 12 is shown. The holster 10 includes a body portion 13 supported by a belt loop assembly 14 with the body 13 including cylinder pockets, one of which 15 appears in FIG. 1 and an over strap 16 which extends over the hammer region of the handgun 11.

The grip 20 of the handgun 11 is completely exposed allowing easy grasp where its trigger guard 21 is nearly covered by the holster body. A protruding section 22 covers the trigger but does not extend beyond the trigger guard 21 so that it does not interfere with the user's grasp of the grip 20. Also, note that no fastener is exposed outward. Thus, bystanders cannot unsnap the strap 16 and it will not come unsnapped by inadvertant brushing contact with any object.

Figure 2:
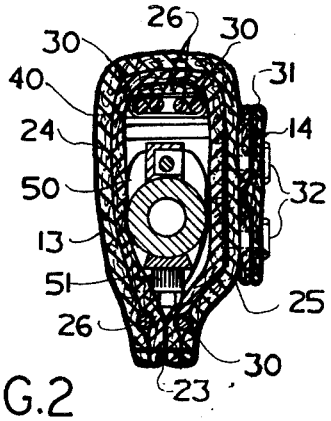
FIG. 2 is a transverse section taken along lines B—B of FIG. 1.

The fact that this is a front opening holster is more apparent in FIG. 2 in which the body 13 defines a front opening 23 with a liner 24 which encloses the handgun, the barrel 50 and front sight 51, all of which are visible in FIG. 2. The body 13 and liner 24 are stitched together at the region of the opening 23 and enclose therebetween a pair of elongated spring members 26 and 30. These spring members 26 and 30 extend substantially the length of the front opening and, as is described below, each extend upward over the cylinder recesses and to the rear of the holster. The two springs 26 and 30 are retained in a clip or pinched tube 40. Each spring, 26 and 30, includes a reentrant end which is nested within the clip 40 providing the four spring sections visible in FIG. 2 within the clip 40.

In FIG. 2, a body stiffener 25, as well as a stiffener 31 for the belt loop assembly 14, may be seen in FIG. 2. Rivets 32 securing the belt loop assembly 14 to the body 13, extending through both stiffeners 25 and 31, are visible in FIG. 2. Most important in this figure is the fact that the spring members 26 and 30 are joined together at the rear and extend longitudinally at the front opening.

Figure 3:
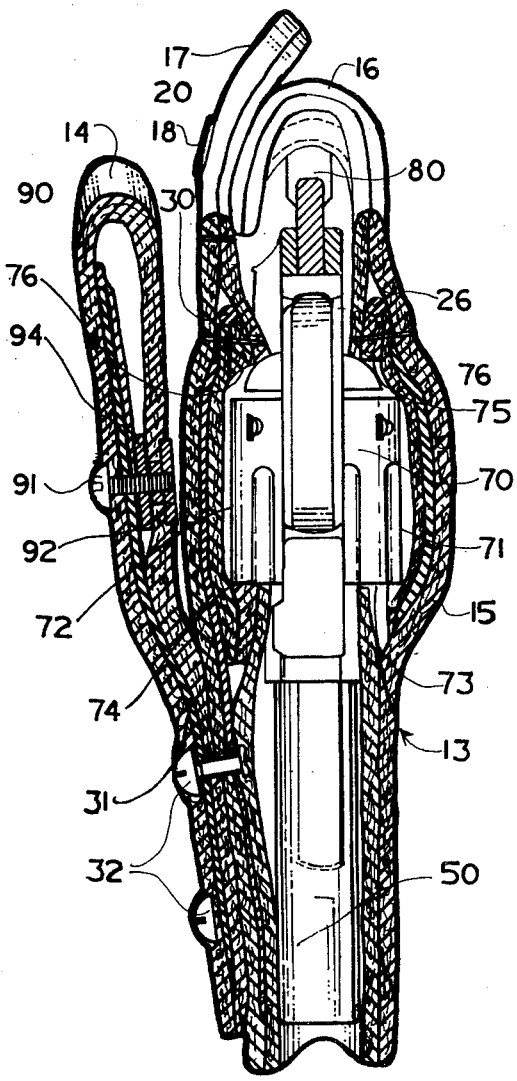
FIG. 3 is a longitudinal section taken along lines A—A of FIG. 1.

The positioning of the handgun within the holster and its relationship to the over strap 16 and thumb strap 17 is apparent in FIG. 3. Also, the low mounting belt loop assembly 14 is visible.

First, considering the handgun 11 within the holster, it is clear in FIG. 3 that the weapon enclosed except for the grip 20 and only leather is in contact with the surface of the handgun 11. The cylinder portion 70 rests within mating cylinder recesses 71 and 72. The front surface of the cylinder 70 rests on a pair of ledges 73 and 74 of the leather while the rear of the cylinder bears against a pair of upper ledges 75 and 76. Ledges 73 and 74 support the handgun when in place and the ledges 75 and 76 prevent the upward withdrawal (similar to my Pat. 3,630,420) under any circumstances.

Note in FIG. 3 that the strap 16 overlies the hammer 80 and thus protects it from being cocked while in the holster. It also is apparent that a fastener 18, holding the straps 16 and 17 together, is located between the holster body 13 and the belt loop 14 in a position inaccessible to anyone other than the wearer.

The fastener 18 preferably is a one direction pull snap fastener such as a "Pull-the-Dot" type directional fastener which will release only if the releasing force is exerted from a selected direction. In case, the fastener is oriented to release only by movement of the wearer's thumb forward. This movement, which is a part of the natural front drawing motion, makes release of the thumb strap automatic upon drawing of the handgun. This arrangement is superior to the strap release as disclosed in earlier U.S. Pat. No. 3,630,420 since it is concealed and uses the thumb and not the fingers in grasping the grip as needed for precise control of the weapon. As is apparent in FIG. 1 when considered with FIG. 3, the body of the holster is canted forward at approximately 10° with respect to the belt loop assembly 14. This brings the thumb strap into a natural position to be released by forward movement of the wearer's thumb.

Another feature of the invention is clear in FIG. 3. We noted above that, in any front opening holster, the act of drawing the handgun exerts horizontal forces on the holster. These forces will tend to move the holster along the wearer's belt. Of course, the holster may be permanently secured to the belt to avoid this problem but such permanence is not desired and limits adjustability.

We have devised a locking mechanism which applies a binding force between the belt and the holster. This mechanism employs the stiffening member 31 contained within the belt loop assembly 14 cooperating with the inner flap 90 of the assembly. Also employed is a screw 91 and tee nut 92, the latter secured to the inner flap 90. Encircling the screw 91 within the belt loop 93 is a resilient washer 94 which may be compressed by tightening screw 91. When screw 91 is tightened, the resilient washer expands radially into engagement with the edge of the belt and the holster is prevented from movement. When screw 91 is backed off, the washer 94 returns to its normal diameter and the holster is free to move along the belt. Thus, the user may position the holster in the exact position desired for comfort and ease of draw and then tighten the screw 91 to lock the holster in place. No wear or abrasion of the belt is encountered by reason of this mechanism since only leather and the resilient, eg. rubber washer 94 contact the belt.

FIG. 3 is also significant since it shows the spring members 26 and 30 also serve to stiffen the body 13 of the holster. Previous front opening holsters needed stiffness above the revolver trigger guard for security. This was accomplished by closing off the area above the guard with stitching. A major disadvantage to this method was that the wearer's hand could not get a full grip on the handgun butt, requiring a change of grip after the draw.

With our spring design, the springs 26 and 30 compress the leather of the body 13 by the trigger guard 21 in the region of protrusion 22 preventing the trigger finger from entering and firing the gun despite the lack of a closure above the trigger guard 21. This prevents an opponent from firing the gun in the holster during his efforts to pull the gun from the holster. While our spring design allows the full security needed, it eliminates the need for a closure above the trigger guard, and allows the wearer's hand to grip the handgun 11 without interference.

As the closure above the trigger guard is a difficult manufacturing step, its elimination greatly improves the holster's production. Also, previous front opening holsters have shared another disadvantage. Handguns most commonly used in such holsters are equipped with projecting adjustable rear sights. Attempts to protect the sight form blows has resulted in designing the holster to enclose it. However, such designs often result in damage to both the sight and the holster from contact with each other as the front opening is forced closed by the spring onto the sight.

In our invention, the mainspring 26 and 30 is formed so that each spring 26 and 20 passes around the sight on respective sides and the sight region is held open by the sections of spring passing down the front opening of the holster. These sections compress to close the holster and prevent loss of the handgun, and rest on each other to maintain the slight opening. This is clearly visible in FIG. 4. Such a design holds the leather away from the sight, yet the heavy spring strongly resists blows and thus protects the delicate handgun sighting mechanism.

Figure 4:
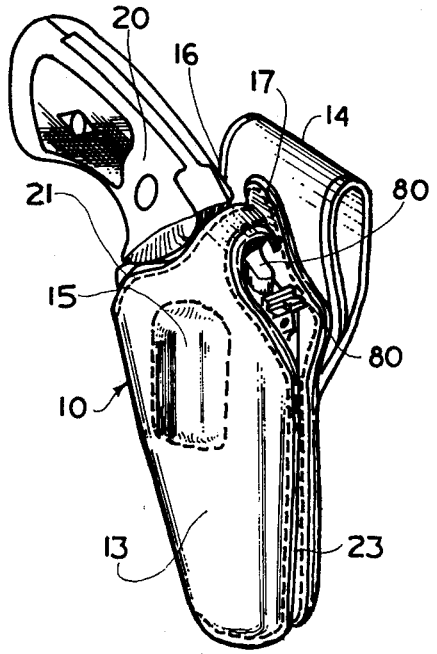
FIG. 4 is a perspective view of holster of FIG. 1.
Figure 5:
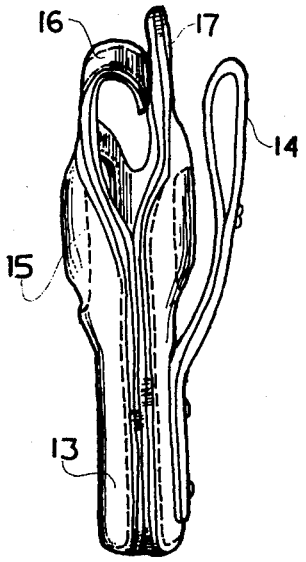
FIG. 5 is a front elevational view of the holster of FIG. 1.

For views of the holster of this invention as seen by a person facing the wearer, FIGS. 4 and 5 should be examined. FIG. 4, in particular shows the thumb strap 17 with the snap fastener totally out of view. The hammer 80 is concealed by strap 16 and the rear sight 82 enclosed but untouched by the holster. The definite cylinder recesses such as 15 are visible and in FIG. 5, the clear spacing between the holster body 13 and the belt loop assembly 14 is visible. This spacing is similar to the arrangement shown in U.S. Pat No. 3,749,293; however, as is described below, both the belt loop assembly 14 and the body 13 have elongated internal stiffening members 25 and 31 which establish the structural stability of the holster body.

Figure 6:
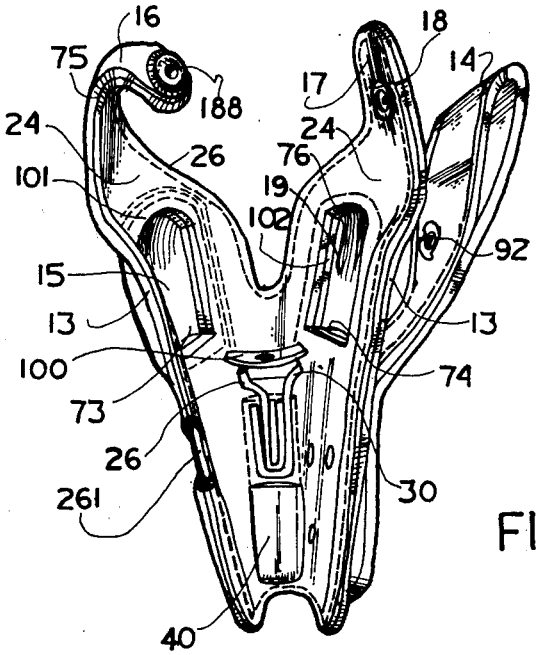
FIG. 6 is a front view of the holster of this invention with the spring retainer disassembled and the holster opened and partially broken away for clarity.

One of the features making this holster possible is apparent in FIG. 6. This view shows the holster ready for its last step of production, namely the insertion of tube 40 into its position surrounding the inner reentrant ends of springs 26 and 30. These two springs 26 and 30 each have a U or reentrant end of different width. The reentrant end of spring 30 is wide enough to enclose the reentrant end of spring 26 within it. In the position shown, with clip 40 removed, the two springs 26 and 30 are relatively movable (pivotable) to allow the holster to be layed substantially flat. Therefore, the two springs 26 and 30 may be inserted separately, sewn in place and then rigidly positioned by pivoting the holster body closed and sliding clip 40 into position over the reentrant ends of springs 26 and 30 for permanent positioning of the two springs 26 and 30.

Figure 7:
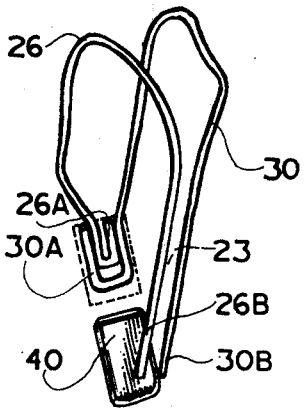
FIG. 7 is a perspective view of the spring assembly of this invention, partly exploded.

The relationship of the springs 26 and 30, when in actual operating position is illustrated in FIG. 7. Note the nested coplanar arrangement of the inner ends 26A and 30A, dimensioned to fill the flattened tube 40 and thus produce a two spring assembly with the free ends 26B and 30B in side by side parallel relationship.

The mainspring connection, you might also note, is not simply a matter of adding the clip 40. The largest connecting loop 30A of spring 30 is longer than the smaller one 26A to allow the clip to be partially inserted before attempting to connect the loops 26A and 26B. The clip 40 is then turned, which turns the largest connecting loop into alignment with the small loop, and the clip is fully inserted to join the two halves. Previous holsters using a one piece spring required that the spring be inserted into the top of the holster, and the holster closed by hand stitching or a complex machine stitching operation. Neither method is suited to mass production, while our invention allows the holster to be mass produced in a simpler manner.

In actuality, the spring assembly is over-biased so that the unrestrained ends 26B and 30B will cross when not sewn into a holster body. They assume the operative position shown in FIG. 7 when in a finished holster. The front opening 23 of FIGS. 2, 4 and 5 falls between the straight portions or ends 26B and 30B.

Again, referring to FIG. 6, the spring assembly of FIG. 7 is totally protected from contact with the gun carried since the major length is sewn into respective sides between the shell 13 and the liner 24. This is illustrated by the dashed line 26 and the portion 26B appearing in the broken away section of the left hand side of the front edge. The springs 26 and 30 are within the body 13 and shell 24 between two lines of stitches. The reentrant ends 26A and 30A within tub 40 are all within the gun cavity after the springs pass through punched holes in the shell 24. These parts are all covered by a flap 100 secured above the spring ends 26A and 30A and tube 40 and extend generally outward into the gun cavity. When so secured above the top of the tube 40, the flat 100 will be forced downward over the tube by the gun frame upon insertion and provides a leather spacer protecting the gun from metal to metal contact with the holster. The outer end of the flap 100 may optionally be secured by gluing or a recessed rivet. This is similar to the recessing of the female fastener part 18A is actually secured to the body 13 and positioned in an opening in the liner 24. This prevents metal to metal contact with the gun. The mating fastener part 18B, located on the top of cross strap 16 is not exposed to the weapon when strap 16 is open so metal to metal contact is avoided there as well.

FIG. 6 also clearly shows the cylinder recesses 15 and 19. These recesses conform to the external size and shape of the particular model handgun to be carried. The recesses 15 and 19 are formed by cutouts in the liner 24 and welts 101 and 102 giving added depth to the recesses and aiding in defining the bottom ledges 73 and 74 as well as top ledges 75 and 76. The cylinder recesses 15 and 19 are further defined precisely by leather (or like material) covered metal cups appearing in FIG. 9.

Cylinder recesses have been used in holsters of various types for nearly 50 years. However, their strength, depth, and effectiveness has always been lacking and none ever fully performed all these functions. Prior front opening designs embody cutouts to accept a revolver cylinder and deepening welts are sometimes used. However, their usage of the welt was limited to either welts on one side or all four sides of the cylinder recess. While support at the face of the cylinder, at the rear of the cylinder, and one side of the cylinder is advantageous, support on the side by the spring opening is a disadvantage. This support serves to bind the revolver cylinder in the recesses and hinder the draw, and prevents the spring opening from closing tightly around the bandgun.

We improved this situation by eliminating this fourth support, and by skiving the leading edges, have created a smooth avenue of exit for the revolver cylinder. This system has been used with great success in our front opening holster, as embodied in U.S. Pat. No. 3,630,420. However, all holsters using the recesses have suffered from the lack of strength depth and effectiveness mentioned earlier. To obtain the necessary depth, we formed the holster face to accept the cylinder.

To obtain depth with strength we added formed metal cups 103 and 104 as shown in FIG. 9 to prevent collapse of the leather during use. These cups also serve to improve the effectiveness of the recesses. By working with the mainspring, the cups 103 and 104 force the leather recesses 15 and 19 against the cylinder and provide uniform pressure to prevent withdrawal from any direction but through the spring open. Thus, the depth obtained with the complicated leather and metal forming is used to full advantage for its purpose of retaining the handgun.

Also, as leather is used in the cutout internal recesses, fatigue of the leather is common. This fatigue is caused both by wear and by naturally soft leather. So, on previous holsters, when fatigue set in, the recesses lost effectiveness and their grip on the cylinder was greatly reduced. With our invention, the metal cups 103 and 104 serve to support the leather and maintain the constant pressure of the recesses against the revolver cylinder, so even if the leather softens, the handgun is still tightly gripped.

In our invention, we use the low mounted belt loop and the back-plate, and the back-plate nearly coincides with the location of the rear cup 104. Rather than weaken the back-plate by shortening it to avoid contacting the cup, and rather than permit contact between the two, we formed the cup 104 into the back-plate 25 to further add rigidity and pressure of the cylinder recess against the handgun.

Figure 8:
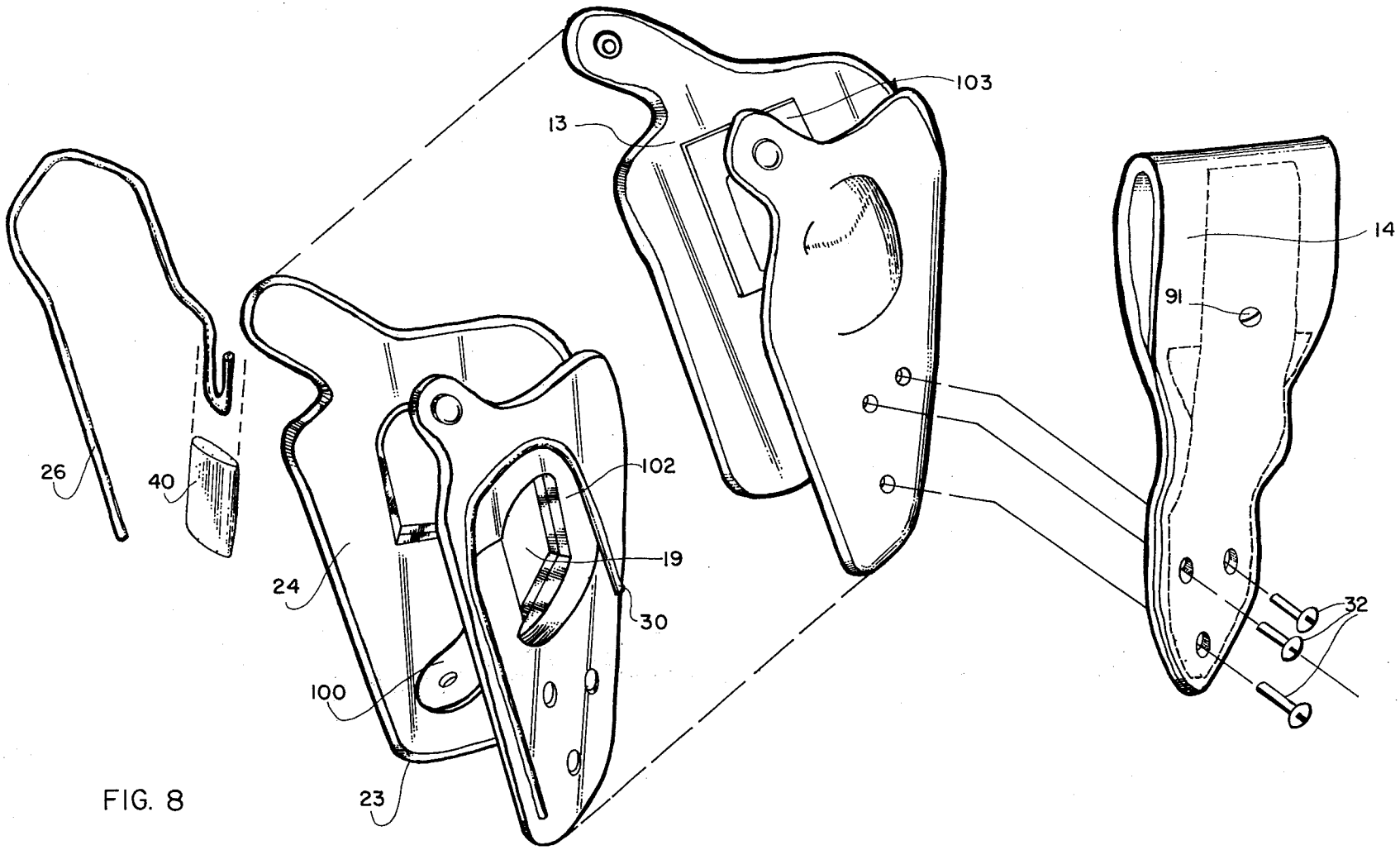
FIG. 8 is a partially exploded view of a holster in accordance with this invention.

The interrelationship of each of the parts may be understood more easily from partially exploded view FIG. 8. There, the liner 24 is shown with spring 30 in place extending along the front opening 23 over the top of the cylinder recess 19, down behind it to the rear of the holster. Spring 26 and tube 40 are shown exploded and separated from the liner 24. It is apparent from this figure that as long as the springs 26 and 30 are disassembled, the holster may be flattened for sewing the springs between the body 13 and the liner 24. The skived welt 102 is clearly visible in FIG. 8. Flap 100 appears in its outward extended position.

The definite cylinder recesses also appear in the body 13, and one of two cylinder cups 103 may be seen bonded to the inner surface of the body 13. As indicated above, the cylinder cups are leather lined to protect the handgun.

The low mounting arrangement of the belt loop assembly 14 is apparent in FIG. 8 employing the concept of U.S. Pat. No. 3,749,293. Reference to that patent should be made to understand the feature minimizing holster tipping upon drawing the handgun. The adjusting screw 91 for locking the holster in any selected position on the belt also is visible in FIG. 9.

Suffice it to say, three rivets or fasteners 32 pass through the belt loop assembly 14, through the body 13, its reinforcement member, not shown in FIG. 8 but visible in FIG. 9, and secure the belt loop assembly 14 to the holster body 13 at the lower region of the holster adjacent to the muzzle of the gun when in place.

In FIG. 9, the fully exploded body 13 is illustrated including the cylinder cup 103 comprising a metal cup 103A with its leather liner 103B defining the cylinder recess 15. The cylinder recess 19 is defined by an integral cup 104 in the reinforcing body plate member 25 plus leather cover 105. This member 25 is of metal such as tempered spring steel, either flat or with reinforcing ribs. This plate member 25 is in riveted engagement with the reinforcing member 31 of the belt loop assembly 14 providing a permanent, rigid, generally Y shaped structure at the inside (near the wearer's body.) Thus, the holster inner wall may not sag. The springs 26 and 30 extending through the body from the rear wall, around the cylinder wells and down the front opening, also cooperate with these stiffening members 25 and 31 as shown in FIGS. 6 and 8 to insure that the body 13 remains rigid.

The thumb strap 17, including the recessed snap fastener 18, also includes an internal stiffener 106 which insures that the thumb member extends upward despite repeated use.

Employing each of these stiffening members. cooperating with the closure springs and defining precise cylinder walls, a degree of precision in handgun carriage not achieved before is now an accomplished fact.

Precise positioning of the holster on the gun belt is also accomplished with the locking arrangement illustrated in FIG. 3. It is more clearly shown in FIGS. 10 and 11. In FIG. 10, the holster belt loop assembly 14 is shown with the screw 91 partially withdrawn and washer 94 uncompressed. The belt 12 may move freely through the belt opening 93. In FIG. 11, the screw 91 has been tightened and washer 94 compressed expanding radially and upward into contact with the edge of the belt 12. The sides of the belt loop are also brought closer together applying pressure to the outside and inside of the belt 12. Thus, the belt is locked from movement by both edge and side compression. When drawn up in this manner, the holster will not move on the belt.

The above described embodiments of this invention are merely descriptive of its principles and are not to be considered limiting. The scope of this invention instead shall be determined from the scope of the following claims including their equivalents.

What is claimed is:

1. A front opening holster comprising:

a body of leather or leather like material including a pair of sides defining a revolver handgun receiving cavity and including internal recesses for receiving opposite sides of the cylinder portion of a revolver handgun, an upper opening through which the grip of a handgun, an upper opening through which the grip of a handgun protrudes and a front opening through which the frame and barrel of the handgun may be removed by forward movement of the handgun;

spring means within said body for maintaining said front opening normally closed in the absence of drawing pressure of the handgun as exerted by the wearer;

said spring means comprising:

a first spring of generally inverted U shape secured to one side of said body and including a bend portion extending over the top of the cylinder receiving portions of said body and an end extending along the other side of said front opening;

a second spring of generally inverted U shape secured to the second of said pair of sides of said body and including a bend portion extending over the top of the cylinder receiving portion of said body and an end extending along the other side of said front opening; and means positioned remote from said front opening for securing said springs together with said ends in substantially parallel relation.

2. The combination in accordance with claim 1 wherein said springs extend into the rear of said holster and into nested engagement within said securing means.

3. The combination in accordance with claim 1 wherein said securing means comprises a tube encircling adjacent ends of said springs.

4. The combination in accordance with claim 1 including a liner within said body and wherein said springs are positioned between said body and said liner except in the region of said securing means.

5. The combination in accordance with claim 4 wherein said liner defines a pair of apertures therethrough and said springs extend through said apertures in said liner in the region of the rear of said body.

6. A front opening holster comprising:

a body leather or leather like material including a pair of sides defining a handgun receiving cavity and including an upper opening through which the grip of a handgun protrudes and a front opening through which the frame and barrel of the handgun may be removed by forward movement of the handgun;

spring means within said body for maintaining said front opening normally closed in the absence of drawing pressure of the handgun as exerted by the wearer;

said spring means comprising;

a first spring secured to one side of said body and including an end extending along one side of said front opening;

a second spring secured to the second of said pair of sides of said body and including an end extending along the other side of said front opening; and means positioned remote from said front opening for securing said springs together with said ends in substantially parallel position;

wherein said liner defines a pair of apertures therethrough and said springs extend through said apertures in said liner in the region of the rear of said body;

and including flap means secured to said liner overlying said springs in the region where said springs extend into the cavity of said holster.

7. A front opening holster comprising:

a body of leather or leather like material including a pair of sides defining a handgun receiving cavity and including an upper opening through which the grip of a handgun protrudes and a front opening through which the frame and barrel of the handgun may be removed by forward movement of the handgun;

spring means within said body for maintaining said front opening normally closed in the absence of drawing pressure of the handgun as exerted by the wearer;

said spring means comprising:

a first spring secured to one side of said body and including an end extending along one side of said front opening;

a second spring secured to the second of said pair of sides of said body and including an end extending along the other side of said front opening; and means positioned remote from said front opening for securing said springs together with said ends in substantially parallel position;

wherein said liner defines a pair of apertures therethrough and said springs extend through said apertures in said liner in the region of the rear of said body;

and wherein said springs include nested reentrant portions and said securing means comprises a metal member having a recess dimensioned to receive said nested reentrant portions and maintain them in rigid relationship with each other.

8. A front opening holster comprising:

a body of leather or leather like material including a pair of sides defining a handgun receiving cavity and including an upper opening through which the grip of a handgun protrudes and a front opening through which the frame and barrel of the handgun may be removed by forward movement of the handgun;

spring means within said body for maintaining said front opening normally closed in the absence of drawing pressure of the handgun as exerted by the wearer;

said spring means comprising:

a first spring secured to one side of said body and including an end extending along one side of said front opening;

a second spring secured to the second of said pair of sides body and including an end extending along the other side of said front opening; and means positioned remote from said front opening for securing said springs together with said ends in substantially parallel position;

including liner means within said body and secured thereto, said liner means including recesses therein in position to mate with the cylinder portion of a handgun within said cavity;

and metal cups within each recess to precisely define the size and shape of said recesses.

9. The combination in accordance with claim 8 wherein at least one of said metal cups is integral with a downward extending reinforcement member positioned between said body and liner.

10. The combination in accordance with claim 9 wherein said reinforcement member extends into the region of the muzzle of the handgun when positioned within said cavity.

11. The combination in accordance with claim 10 including belt loop means secured to the side of said body including said reinforcement means and rigidly connected to said reinforcement means.

12. The combination in accordance with claim 11 wherein said belt loop means includes elongated reinforcement means secured to the reinforcement means of said body.

* * * * *